United States Patent [19]

Coccia

[11] Patent Number: 4,872,494

[45] Date of Patent: Oct. 10, 1989

[54] APPARATUS WITH SAFETY LOCKING MEMBERS, FOR CONNECTING A SYTRINGE TO A BOTTLE CONTAINING A MEDICAMENT

[75] Inventor: Mario Coccia, Cesano Boscone, Italy

[73] Assignee: Farmitalia Carlo Erba S.r.l., Milan, Italy

[21] Appl. No.: 256,575

[22] Filed: Oct. 12, 1988

[30] Foreign Application Priority Data

Oct. 14, 1987 [IT] Italy ..... 22283 A/87

[51] Int. Cl.[4] ..... B65B 3/04; A61H 5/00

[52] U.S. Cl. ..... 141/383; 141/27; 141/329; 141/369; 141/387; 604/403; 604/411; 604/415; 604/905; 141/97

[58] Field of Search ..... 141/329, 330, 25–27, 141/382, 383, 385, 386, 387, 388, 389, 311 R, 369, 370, 372, 379, 97, 312, 346, 347, 367; 604/411–415, 905, 201, 207, 240, 403

[56] References Cited

U.S. PATENT DOCUMENTS

| | | | |
|---|---|---|---|
| 4,092,546 | 5/1978 | Larrabee | 141/27 X |
| 4,564,054 | 1/1986 | Gustavsson | 141/329 |
| 4,576,211 | 3/1986 | Valentini et al. | 141/329 |
| 4,684,365 | 8/1987 | Reinicke | 604/413 X |
| 4,768,568 | 9/1988 | Fournier et al. | 141/286 |

FOREIGN PATENT DOCUMENTS

| | | | |
|---|---|---|---|
| 864605 | 5/1941 | France | 141/383 |
| 8801881 | 3/1988 | PCT Int'l Appl. | 604/905 |

*Primary Examiner*—Ernest G. Cusick

*Attorney, Agent, or Firm*—Oblon, Spivak, McClelland, Maier & Neustadt

[57] ABSTRACT

The invention relates to an apparatus for connecting a bottle containing a medicament to a syringe the needle of which is housed in a closed chamber defined by the apparatus and from which the needle can be made to emerge by sliding the separate constituent parts of the appartus along each other. To prevent the needle from emerging from the chamber when no bottle is housed in the appropriate seat provided in the apparatus, there extends from one of the parts of the apparatus an elongated flexible appendix having at least one protuberance which projects into the seat and against which the bottle presses when inserted into the seat, so bending the appendix outwards. In front of the free end of the appendix there is provided a stop tooth projecting from that consituent part of the apparatus which is projecting from that constituent part of the apparatus which is mobile along the first part and extends totally around the seat. When no bottle is inserted into the seat in the apparatus, it is impossible to move the various parts of the apparatus along each other because the free end of the flexible appendix makes contact with and halts against the stop tooth, to thus prevent the needle from emerging from the chamber.

8 Claims, 1 Drawing Sheet

APPARATUS WITH SAFETY LOCKING MEMBERS, FOR CONNECTING A SYTRINGE TO A BOTTLE CONTAINING A MEDICAMENT

FIELD OF THE INVENTION

The invention relates to an improvement in apparatus for connecting a bottle containing a medicament to a syringe used to withdraw the medicament from the bottle, possibly after feeding into the bottle a solvent or the like.

BACKGROUND OF THE INVENTION

More specifically, the apparatus is of the type described in U.S. Pat. No. 4,576,211. The apparatus described in the patent comprises several mutually mobile constituent parts. At one end it contains a seat into which the end of a syringe can be fitted so that its needle extends into a closed chamber bounded by the apparatus, and at its other end it comprises a seat for housing the mouth of a bottle containing a medicament. The various constituent parts of the apparatus can move axially along each other to securely lock the bottle mouth in its seat by means of retention teeth projecting from flexible tongues. Additionally, the axial motion of the various constituent parts of the apparatus causes the point and a portion of the needle to emerge from the chamber in the apparatus so that the needle can perforate an elastic plug fitted in the bottle opening and can penetrate into the bottle, to be able to inject into the bottle liquid contained in the syringe or to draw into the syringe liquid contained in the bottle. While the bottle is connected to the apparatus, the needle is always contained within the apparatus chamber or (party) within the bottle—i.e., the needle is never freely exposed and accessible from the outside.

The apparatus described in U.S. Pat. No. 4,576,211 has, however, the drawback that, if no bottle is inserted into its seat in the apparatus, the apparatus can still be erroneously. or accidentally operated in the sense of moving the various component parts along each other to cause the needle to emerge from its protection chamber. In such a case, the needle would project outwards from the apparatus and be accessible from the outside, with consequent danger in terms of loss of needle sterility and even greater danger if a high-risk medicament such as an antitumoral drug has already been drawn into the syringe.

OBJECT OF THE INVENTION

The object of the present invention is, therefore, to obviate the aforesaid drawback—i.e.,—to prevent the various constituent parts of the apparatus from being able to move along each other when no bottle mouth (or the like) is inserted into its seat in the apparatus, to thus prevent the needle emerging from the closed chamber provided in the apparatus.

SUMMARY OF THE INVENTION

The object of this invention is attained by an apparatus comprising several constituent parts. The apparatus has at one end a first seat for housing the end of a syringe the needle of which extends into a closed chamber in the apparatus. At the other end of the apparatus there is provided a second seat for housing the mouth of a bottle or the like. The constituent parts are mobile along each other between a travel stop at which th needle is entirely housed within the chamber and a travel stop at which the free end of the needle and a portion of the needle emerge from the chamber to extend through a perforable plug and into the second seat. The apparatus is characterised in that from one of the constituent parts there extends a flexible appendix comprising at least one protuberance projecting into the second seat. Another of the constituent parts is provided with a stop tooth positioned in front, and in the immediate vicinity, of the free end of the flexible appendix when in its rest position.

DESCRIPTION OF THE DRAWINGS

The structure and characteristics of the apparatus will be more apparent from the description given hereinafter by way of non-limiting example with reference to the accompanying drawing, in which.

DETAILED DESCRIPTION OF THE PRESENTLY PREFERRED EMBODIMENT

Figure 1:
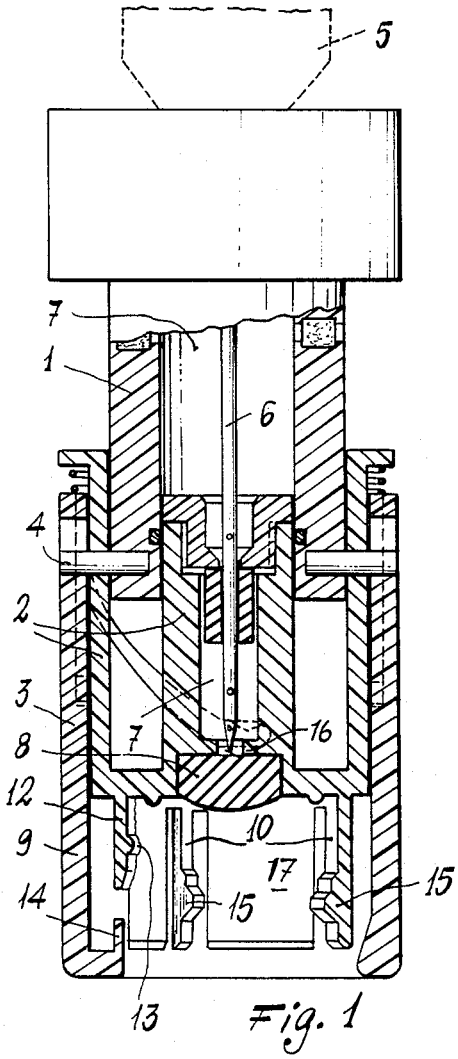
FIG. 1 is a partly sectional view of the apparatus in its rest state, with the needle completely retracted into the closed chamber of the apparatus.

The apparatus shown on the drawing comprises three separate main constituent parts, namely a radially inner part 1, an intermediate part 2, and a radially outer part 3. Pins 4 are rigid with one of these parts and extend radially into axially extending grooves formed in the other two parts. In this manner the three parts 1, 2 and 3 are coupled to each other but can be moved axially along each other.

The radially inner part 1 comprises a seat (not shown) to house and retain the free end of a syringe 5. With the radially inner part for the syringe 5 there is rigid a needle 6 which, when the apparatus is in use, is securely connected to the syringe inlet and outlet hole.

When the apparatus is in its rest state—i.e., not in use (FIG. 1) the needle 6 is completely enclosed and protected within a chamber 7 defined by the radially inner part 1 and the intermediate part 2. At its lower end, below the needle point, the intermediate part 2 has a hole 16 hermetically sealed by a perforable plug 8 of rubber or a similar material.

The radially outer part 3 extends downwards (with reference to the figures of the drawing) beyond the intermediate part 2 in the form of a shaped continuous tubular wall 9 which has its free end enlarged in an inward direction. Flexible retention elements 10 extend from the lower end of the intermediate part 2 there extend the flexible retention elements 10. The outer surfaces of the flexible retention elements 10 are sized, shaped, and positioned so as not to interfere with the free edge of the tubular wall 9 when the parts 1, 2 and 3 are superposed on each other to their maximum extent (FIG. 2), provided that the flexible retention elements 10 are —free—i.e., provided that no bottle is connected to the apparatus.

In this respect, the flexible retention elements 10 define a housing seat 17, in which the mouth of a bottle 11 having a lip 18 can be inserted and retained. In FIG. 1 no bottle 11 is inserted in the housing seat 17 the apparatus is in its rest state, and the flexible retention elements 10 can bend both inwards and outwards. Under these conditions (FIG. 1), if the mouth of a bottle 11 is inserted into the housing seat 17 defined by the flexible retention elements 10, the flexible retention elements 10 are bent freely outwards by the lip 18 which interferes with protuberances 15 projecting from these elements. When the bottle 11 has been inserted into the seat 17 in the described manner, the parts 1, 2 and 3 can be moved along each other (FIG. 2) so that the radially inner surface of the free edge of the tubular wall 9 rests against the radially outer surface of the flexible retaining elements 10, which can therefore not bend further outwards. The result is that when in this position, the protuberances 15 projecting inwards from the flexible retention elements 10 are locked under the lip 18 of the bottle, which can therefore not be removed from the apparatus. It will be noted that, when the apparatus is in the position shown in FIG. 1, the needle 6 is completely housed within the chamber 7, whereas when the apparatus is in the position shown in FIG. 2, the needle 6 has passed through the perforable plug 8 and extends into the bottle 11.

The apparatus described up to this point is of a well known type, and it is illustrated in U.S. Pat. No. 4,576,211, the disclosure of which is hereby incorporated herein by reference. This apparatus has considerable merit, but it has the drawback that, if no bottle is inserted between the flexible retention elements 10, the parts 1, 2 and 3 can still be moved freely along each other to cause the needle 6 to emerge from the chamber 7 of the apparatus. The point of the needle 6 and a portion thereof are therefore exposed and freely extending outside the apparatus, a situation which can be very dangerous if the syringe is filled with a potentially toxic medicament, such as an antitumoral drug.

To prevent this happening—i.e., to allow the point of the needle 6 pass beyond the perforable plug 8 only when the mouth of a bottle 11 is inserted between the flexible retention elements 10, according to the present invention there projects from the lower end of the intermediate part 2 at least one flexible appendix 12 having a protuberance 13 projecting towards the housing seat 17. The free end of a stop tooth 14 which projects upwards from the edge of the tubular wall 9 of the radially outer part 3 is positioned in front of the free end of the flexible appendix 12 (when in the rest state of FIG. 1).

Assuming that the conditions of FIG. 1 apply, if an attempt is made to slide the parts 1, 2, 3 along each other, the free end of the flexible appendix 12 makes contact with the free end of the stop tooth 14 to prevent any further sliding of the parts along each other, and thus prevent the needle 6 from emerging from the perforable plug 8.

It will again be assumed that the rest conditions of FIG. 1 apply, but that the mouth of a bottle 11 is now inserted into the housing seat 17. As the the bottle mouth is inserted into the housing seat 17, the lip 18 firstly acts against the protuberances 15 projecting from the flexible retention elements 10 (so urging the flexible retention elements 10 radially outwards), and then acts against the protuberance 13, so bending the flexible appendix 12 radially outwards. Under these conditions, the parts 1, 2, 3 can be freely slid along each other (and the needle 6 can perforate and project below the perforable plug 8) because the flexible appendix 12 is in an outwardly bent state and its free end no longer comes into contact with the stop tooth 14. Thus the presence of the flexible appendix 12 with its protuberance 13 and the presence and positioning of the stop tooth 14 assure that the needle 6 can be made to project below the perforable plug 8 (and thus be freely extending and accessible from the outside) only when a medicament bottle mouth or an object reproducing the shape of such a bottle mouth is housed between the flexible retention elements 10.

Figure 2:
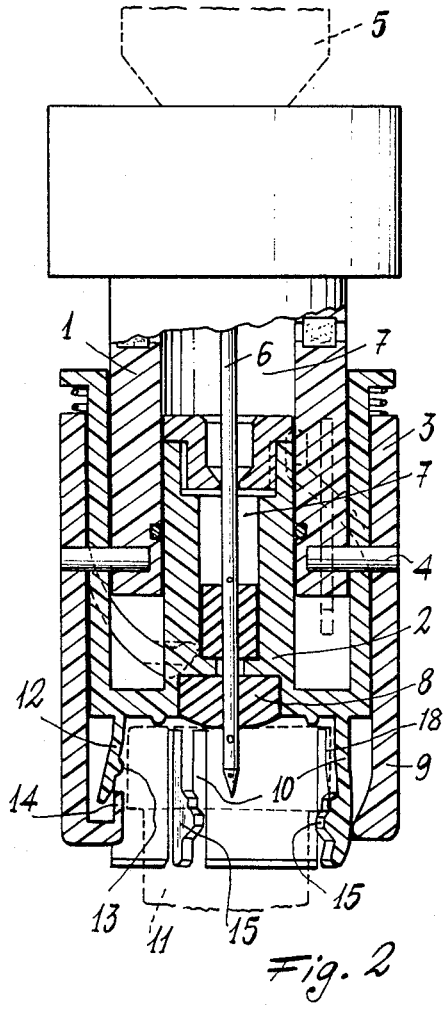
FIG. 2 shows the same apparatus connected to a bottle mouth and with the syringe needle projecting from the closed chamber and extending into the bottle.

It should be noted that, when in the state shown in FIG. 2, the protuberances 15 are positioned below the lower edge (relative to the figures) of the lip 18 of the bottle 11, so preventing the removal from the apparatus as the flexible retention elements 10 now rest against the free edge of the tubular wall 9 and cannot therefore bend outwards.

The present invention also incorporates the following further characteristic. As stated, when in the state shown in FIG. 2, the protuberances 15 hook onto and securely retain a bottle neck.

Most bottles have a mouth with a projecting lip 18 of constant defined height or thickness. There are however, bottles with lips of a different height—for example, greater than that of the bottle shown by dashed lines in FIG. 2.

In the apparatus described in U.S. Pat. No. 4,576,211 the flexible retention elements 10 are provided with protuberances able to hook only onto bottles having necks of a defined constant height.

Figure 3:
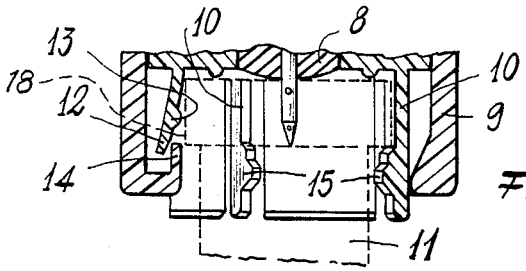
FIG. 3 shows only an end portion of the apparatus in the state shown in FIG. 2, but with a bottle neck of different thickness from that shown in FIG. 2.

As can be seen from the drawings accompanying this description, the protuberances 15 are shaped stepwise with the tallest or most projecting step positioned at the free end of the flexible retention elements 10. In this manner, when the bottle lip is of smaller height, it is hooked by a shorter step on the protuberances 15 (FIG. 2), whereas if the bottle lip is of greater height (FIG. 3), it is hooked by a taller step on the protuberances 15.

The apparatus is, therefore, more versatile than the known type and can be used with bottles of different structure.

I claim:

1. Apparatus for connecting a syringe to a bottle having a lip surrounding a mouth, said apparatus comprising:

(a) a radially inner hollow part having a first end containing a first seat for a syringe and a second end;

(b) an intermediate hollow part slidably received in said radially inner hollow part and having a first open end and a second open end;

(c) a radially outer part slidably received on said intermediate hollow part and having a first end and a second end;

(d) a perforable plug received in said second open end of said intermediate hollow part;

(e) a plurality of flexible retention elements projecting axially from said second open end of said interemdiate hollow part radially outwardly of said perforable plug;

(f) at least one flexible appendix projecting axially from said second open end of said intermediate hollow part radially outwardly of said perforable plug;

(g) at least one stop tooth projecting axially from said second open end of said radially outer part towards said at least one flexible appendix; and (h) means for limiting the axial movement of said parts relative to each other so as to define a first position, in which the overall length of said apparatus is at a maximum, and a second position, in which the overall length of said apparatus is at a minimum, wherein (i) said radially inner hollow part and said first open end of said intermediate part together define a chamber which, in the first position of said apparatus, has an axial length such that, in use, it entirely contains a needle in fluid communication with a syringe received in said first seat and which, in the second position of said apparatus, has an axial length such that, in use, the same needle projects through said perforable plug;

(j) said plurality of flexible retention elements and said second open end of said intermediate hollow part together define a second seat sized, shaped, and positioned to receive and to grip the lip of a bottle; and (k) said at least one flexible appendix is sized, shaped, and positioned so that:

(i) it is cammed radially outwardly when the lip of a bottle is received in said second seat, permitting said apparatus to assume its second position, and (ii) when it is not cammed radially outwardly, it abuts against said at least one stop tooth at a point during the axial movement of said parts relative to each other that prevent said apparatus from assuming its second position.

2. Apparatus as recited in claim 1 wherein said at least one flexible appendix and said at least one stop tooth are sized, shaped, and positioned so that, when said at least one flexible appendix is not cammed radially outwardly, a needle in fluid communication with a syringe received in said first seat cannot project through said perforable plug.

3. Apparatus as recited in claim 1 wherein the needle is rigidly mounted on said radially inner part and, consequently, is a part of said apparatus.

4. Apparatus as recited in claim 1 wherein the needle is rigidly mounted on the syringe and, consequently, is not a part of said apparatus.

5. Apparatus as recited in claim 1 wherein:

(a) a plurality of axially spaced protuberances project radially inwardly from each one of said plurality of flexible retention elements;

(b) the length in the radial direction of said plurality of axially spaced protuberances increases toward said second end of said radially outer part; and (c) the length in the radial direction of each one of said plurality of axially spaced protuberances on each one of said plurality of flexible retention elements is the same as the length in the radial direction of corresponding ones of said plurality of axially spaced protuberances on the other ones of said plurality of flexible retention elements at the same axial spacing from said intermediate hollow part;

whereby said plurality of flexible retention elements are adapted to grip bottles having lips with different axial lengths.

6. Apparatus for connecting a syringe to a bottle having a lip surrounding a mouth, said apparatus comprising:

(a) a radially inner hollow part having a first end containing a first seat for a syringe and a second end;

(b) an intermediate hollow part slidably received in said radially inner hollow part and having a first open end and a second open end;

(c) a radially outer part slidably received on said intermediate hollow part and having a first end and a second end;

(d) a perforable plug received in said second open end of said intermediate hollow part;

(e) a plurality of flexible retention elements projecting axially from said second open end of said intermediate hollow part radially outwardly of said perforable plug; and (f) means for limiting the axial movement of said parts relative to each other so as to define a first position, in which the overall length of said apparatus is at a maximum, and a second position, in which the overall length of said apparatus is at a minimum, wherein (g) said radially inner hollow part and said first open end of said intermediate hollow part together define a chamber which, in the first position of said apparatus, has an axial length such that, in use, it entirely contains a needle in fluid communication with a syringe received in said first seat and which, in the second position of said apparatus, has an axial length such that, in use, the same needle projects through said perforable plug;

(h) said plurality of flexible retention elements and said second open end of said intermediate hollow part together define a second seat sized, shaped, and positioned to receive and to grip the lip of a bottle; and (i) a plurality of axially spaced protuberances project radially inwardly from each one of said plurality of flexible retention elements;

(j) the length in the radial direction of said plurality of axially spaced protuberances increases towards said second end of said radially outer part; and (k) the length in the radial direction of each one of said plurality of axially spaced protuberances on each one of said plurality of flexible retention elements is the same as the length in the radial direction of corresponding ones of said axailly spaced protuberances on the other ones of said plurality of flexible retention elements at the same axial spacing from said intermediate hollow part, whereby said plurality of flexible retention elements are adapted to grip bottles having lips with different axial lengths.

7. Apparatus as recited in claim 6 wherein the needle is rigidly mounted on said radially inner part and, consequently, is a part of said apparatus.

8. Apparatus as recited in claim 6 wherein the needle is rigidly mounted on the syringe and, consequently, is not a part of said apparatus.

* * * * *

UNITED STATES PATENT AND TRADEMARK OFFICE

CERTIFICATE OF CORRECTION

PATENT NO. : 4,872,494

DATED : Oct. 10, 1989

INVENTOR(S) : Mario Coccia

It is certified that error appears in the above-identified patent and that said Letters Patent is hereby corrected as shown below:

The title is incorrectly recorded, "APPARATUS WITH SAFETY LOCKING MEMBERS, FOR CONNECTING A SYTRINGE TO A BOTTLE CONTAINING A MEDICAMENT", should be:

--APPARATUS WITH SAFETY LOCKING MEMBERS, FOR CONNECTING A SYRINGE TO A BOTTLE CONTAINING A MEDICAMENT--

Signed and Sealed this

Thirtieth Day of October, 1990

*Attest:*

*Attesting Officer*

HARRY F. MANBECK, JR.

*Commissioner of Patents and Trademarks*